US010483685B2

(12) United States Patent
Hu et al.

(10) Patent No.: US 10,483,685 B2
(45) Date of Patent: Nov. 19, 2019

(54) WATERPROOF COVER, CONNECTION DEVICE AND MOBILE TERMINAL

(71) Applicant: GUANGDONG OPPO MOBILE TELECOMMUNICATIONS CORP., LTD., Dongguan, Guangdong (CN)

(72) Inventors: Haijin Hu, Guangdong (CN); Xinquan Zhou, Guangdong (CN); Yimei Tang, Guangdong (CN); Yi Sun, Guangdong (CN); Jingming Wan, Guangdong (CN)

(73) Assignee: GUANGDONG OPPO MOBILE TELECOMMUNICATIONS CORP., LTD., Dongguan, Guangdong (CN)

( * ) Notice: Subject to any disclaimer, the term of this patent is extended or adjusted under 35 U.S.C. 154(b) by 0 days.

(21) Appl. No.: 15/890,793

(22) Filed: Feb. 7, 2018

(65) Prior Publication Data

US 2018/0248300 A1 Aug. 30, 2018

(30) Foreign Application Priority Data

Feb. 27, 2017 (CN) ..... 2017 1 0109852

(51) Int. Cl.
*H01R 13/52* (2006.01)

(52) U.S. Cl.
CPC ..... *H01R 13/5202* (2013.01); *H01R 13/521* (2013.01); *H01R 13/5213* (2013.01)

(58) Field of Classification Search
CPC ..... H01R 13/5219; H01R 13/5221; H01R 13/5208; H01R 13/5205; H01R 13/5202;
(Continued)

(56) References Cited

U.S. PATENT DOCUMENTS 3,120,987 A 2/1964 Degan et al.
4,917,620 A * 4/1990 Samejima ..... H01R 13/5219 439/271

(Continued)

FOREIGN PATENT DOCUMENTS

CN 103337735 A 10/2013
CN 103444007 A 12/2013

(Continued)

OTHER PUBLICATIONS

Written Opinion dated Apr. 28, 2018 for Application No. PCT/CN2018/074350.

(Continued)

*Primary Examiner* — Thanh Tam T Le
(74) *Attorney, Agent, or Firm* — Ladas & Parry LLP

(57) ABSTRACT

A waterproof cover for a connector is disclosed. The waterproof cover includes a water blocking portion configured to surround a periphery of a connector; a sealing portion fastened to an end of the water blocking portion, configured to be sleeved on a tail end of the connector to seal the tail end of the connector, to block water in a space between the water blocking portion and the connector. The water blocking portion can surround the periphery of the connector, and block the water leaking from the periphery of the connector from flowing outwards from the connector. The sealing portion can prevent water from leaking from the tail end of the connector to the outside of the connector, and block in a space between the water blocking portion and the connector. A connection device and a mobile terminal are also disclosed.

19 Claims, 12 Drawing Sheets

(58) Field of Classification Search
CPC ..... H01R 23/6873; H01R 13/65802; H01R 13/465; H01R 13/641
USPC ..... 439/271–275, 279, 559, 587, 607.13, 439/607.27, 607.35, 488, 489
See application file for complete search history.

(56) References Cited

U.S. PATENT DOCUMENTS

| | | | | |
|---|---|---|---|---|
| 5,108,303 | A * | 4/1992 | Maeda | H01R 13/5219 439/271 |
| 5,433,621 | A * | 7/1995 | Sai | H01R 13/5205 439/275 |
| 5,603,637 | A * | 2/1997 | Matsuoka | H01R 13/5205 439/587 |
| 5,662,336 | A * | 9/1997 | Hayashi | H01R 13/5205 277/607 |
| 5,667,406 | A * | 9/1997 | Tabata | H01R 13/5205 439/587 |
| 5,711,066 | A | 1/1998 | Castaldo | |
| 5,720,487 | A * | 2/1998 | Kato | H01R 13/5205 277/637 |
| 5,857,873 | A | 1/1999 | Castaldo | |
| 6,045,383 | A * | 4/2000 | Fujiwara | H01R 13/5219 439/271 |
| 6,244,886 | B1 * | 6/2001 | Strang | H01R 13/5202 439/271 |
| 6,558,178 | B2 * | 5/2003 | Nakamura | H01R 13/5221 439/271 |
| 6,840,804 | B2 * | 1/2005 | Murakami | H01R 13/5205 439/587 |
| 7,033,215 | B2 * | 4/2006 | Kobayashi | H01R 4/185 439/587 |
| 7,214,075 | B2 | 5/2007 | He | |
| 7,347,730 | B2 * | 3/2008 | Kameyama | H01R 9/032 174/650 |
| 7,645,166 | B1 * | 1/2010 | Wang | H01R 13/641 439/488 |
| 7,922,535 | B1 * | 4/2011 | Jiang | H01R 13/5205 439/271 |
| 7,997,916 | B2 * | 8/2011 | Yoshioka | H01R 13/5205 439/271 |
| 8,400,031 | B2 * | 3/2013 | Bitzer | H01R 13/5205 174/152 G |
| 8,460,025 | B2 * | 6/2013 | Segawa | H01R 13/641 439/489 |
| 9,028,273 | B2 * | 5/2015 | Smith | H01R 13/5205 439/271 |
| 9,397,438 | B2 * | 7/2016 | Chen | H01R 13/5202 |
| 9,429,360 | B2 * | 8/2016 | Hsiao | F26B 3/28 |
| 9,711,910 | B2 * | 7/2017 | Zhao | H01R 13/6581 |
| 10,027,052 | B2 * | 7/2018 | Yudate | H01R 13/5202 |
| 2007/0206365 | A1 | 9/2007 | Shiu | |
| 2015/0004814 | A1 | 1/2015 | Feldmeier | |

FOREIGN PATENT DOCUMENTS

| | | | |
|---|---|---|---|
| CN | 203434356 | U | 2/2014 |
| CN | 203707456 | U | 7/2014 |
| CN | 203942083 | U | 11/2014 |
| CN | 204760645 | U | 11/2015 |
| CN | 205016763 | U | 2/2016 |
| CN | 205303802 | U | 6/2016 |
| CN | 106452494 | A | 2/2017 |
| CN | 107026359 | A | 8/2017 |
| CN | 206451915 | U | 8/2017 |
| KR | 10-2013-0062711 | A | 6/2013 |
| TW | M447008 | U | 2/2013 |
| WO | 2014/077502 | A1 | 5/2014 |

OTHER PUBLICATIONS

International Search Report dated May 2, 2018 for Application No. PCT/CN2018/07350.
European Search Report dated Apr. 26, 2018 for Application No. EP 18 154 675.5.
English abstract for CN 203434356 U.
English abstract for KR 10-2013-0062711 A.
English abstract for CN 204760645 U.
English abstract for CN 107026359 A.
English abstract for CN 206451915 U.
English abstract for CN 203707456 U.
English abstract for CN 205016763 U.
English abstract for CN 103337735 A.

* cited by examiner

WATERPROOF COVER, CONNECTION DEVICE AND MOBILE TERMINAL

CROSS REFERENCE TO RELATED APPLICATIONS

This application claims priority to Chinese patent application No. 201710109852.8 titled "WATERPROOF COVER, CONNECTION DEVICE AND MOBILE TERMINAL", and filed on Feb. 27, 2017, the disclosures for which are hereby incorporated herein in their entireties by reference.

TECHNICAL FIELD

The present disclosure relates to an electronic equipment field, and more particularly, to a waterproof cover, a connection device and a mobile terminal.

BACKGROUND

At present, with the development of the electronic technology, more and more electronic products need to deal with various complicated environments. For example, as a daily article, a mobile phone needs to consider how to keep water out. In particular, a connector for the mobile phone needs to be inserted with or extracted from an external plug frequently, so that an insertion port of the connector needs to be exposed to external environment. When the mobile phone is in water environment, water may get inside the connector from the insertion port of the connector, and further get inside the mobile phone through the connector, which will result in a security incident. Currently there is no waterproof cover to prevent water from flowing into the mobile phone through the connector.

SUMMARY

The present disclosure provides a waterproof cover, a connection device and a mobile terminal, which may prevent water from leaking outside from a connector.

According to one aspect of the disclosure, a waterproof cover for a connector is provided. The waterproof cover includes: a water blocking portion, configured to surround a periphery of the connector; and a sealing portion, fastened to an end of the water blocking portion, configured to be sleeved on a tail end of the connector to seal the tail end of the connector, to block water in a space between the water blocking portion and the connector.

According to an additional aspect of the disclosure, a connection device is provided. The connection device includes a waterproof cover according to the above aspect, and a connector fit into the water blocking portion. The tail end of the connector passes through the sealing portion of the waterproof cover and is configured to be connected to a conductive wire.

According to a further aspect of the disclosure, a mobile terminal is provided. The mobile terminal includes a connection device according to the above aspect, and a housing. The housing has an aperture. The connector passes through the aperture, and the sealing portion seals the aperture.

For the waterproof cover, the connection device and the mobile terminal according to the present disclosure, the water blocking portion can surround the periphery of the connector, and block the water leaking from the periphery of the connector from flowing outwards from the connector, so as to achieve the waterproof of the periphery of the connector. The sealing portion can seal the tail end of the connector, to prevent water from leaking from the tail end of the connector to the outside of the connector, and it also can block water in a space between the water blocking portion and the connector. The waterproof cover can seal the connector well, so that the water getting inside the connector is unable to leak outside from the connector, to achieve the protection effect and to improve the safety performance.

BRIEF DESCRIPTION OF THE DRAWINGS

To more clearly illustrate the technical solutions proposed in the present disclosure, a brief description of the drawings that are necessary for describing embodiments of the present disclosure is given below. It is obvious that the drawings that will be described below show only some embodiments of the present disclosure and for those having ordinary skills of the art, other drawings may also be readily available from these attached drawings without the expense of creative effort and endeavor.

DETAILED DESCRIPTION

Figure 1:
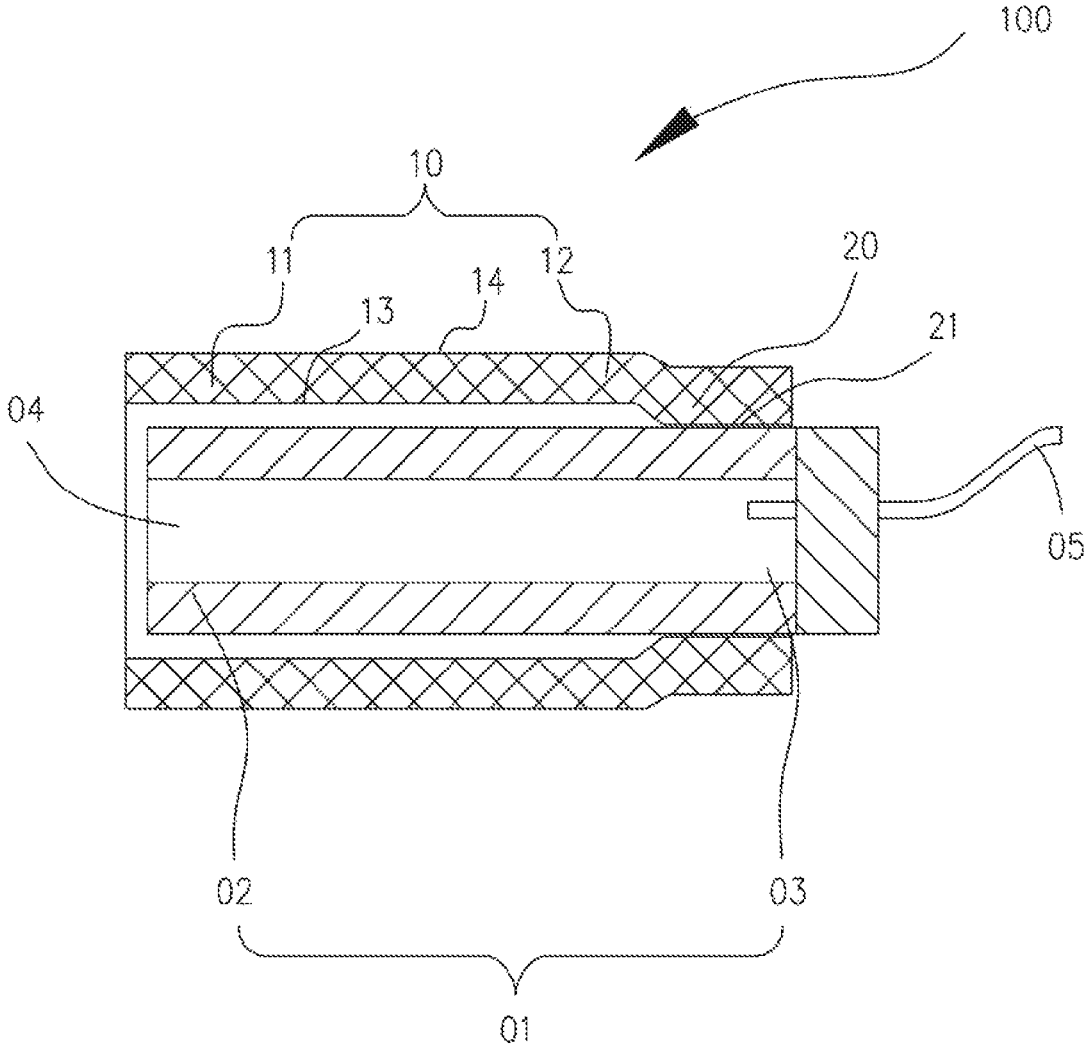
FIG. 1 is a schematic cross-sectional view of a waterproof cover according to a first embodiment of the present disclosure.

A clear and complete description will be given to technical solutions of the embodiments of the present disclosure with reference to the attached drawings of the embodiments of the present disclosure.

Reference will be made in detail to embodiments of the present disclosure. The same or similar elements and the elements having same or similar functions are denoted by like reference numerals throughout the descriptions. The embodiments described herein with reference to drawings are explanatory, illustrative, and used to generally understand the present disclosure. The embodiments shall not be construed to limit the present disclosure.

When a feature or element is herein referred to as being "on" another feature or element, it can be directly on the other feature or element or intervening features and/or elements may also be present. In contrast, when a feature or element is referred to as being "directly on" another feature or element, there are no intervening features or elements present. It will also be understood that, when a feature or element is referred to as being "connected", "attached" or "coupled" to another feature or element, it can be directly connected, attached or coupled to the other feature or element or intervening features or elements may be present. In contrast, when a feature or element is referred to as being "directly connected", "directly attached" or "directly coupled" to another feature or element, there are no intervening features or elements present. Although described or shown with respect to one embodiment, the features and elements so described or shown can apply to other embodiments. It will also be appreciated by those of skill in the art that references to a structure or feature that is disposed "adjacent" another feature may have portions that overlap or underlie the adjacent feature.

Terminology used herein is for the purpose of describing particular embodiments only and is not intended to be limiting of the invention. For example, as used herein, the singular forms "a", "an" and "the" are intended to include the plural forms as well, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

Although the terms "first" and "second" may be used herein to describe various features/elements, these features/elements should not be limited by these terms, unless the context indicates otherwise. These terms may be used to distinguish one feature/element from another feature/element. Thus, a first feature/element discussed below could be termed a second feature/element, and similarly, a second feature/element discussed below could be termed a first feature/element without departing from the teachings of the present invention.

With reference to FIG. 1, the present disclosure provides a waterproof cover 100 for a connector. The waterproof cover 100 includes a water blocking portion 10 and a sealing portion 20 fastened to an end of the water blocking portion 10. The water blocking portion 10 is configured to surround a periphery of the connector. The sealing portion 20 is configured to be sleeved on a tail end of the connector, so that the sealing portion 20 seals the tail end of the connector 10 to block water from coming into a space between the connector 01 and the water blocking portion 10. It is understandable that the waterproof cover 100 can be sleeved on the connector 01. The connector 01 may be an USB (Universal Serial Bus) socket, a headphone socket, a TF (Trans Flash) card socket, a SD (Secure Digital) card socket or the like. In this particular embodiment, using an USB socket as an example of the connector 01, make following description for reference. The connector 01 and the waterproof cover 100 can be applied in a mobile terminal together. The mobile terminal can be a mobile phone, a tablet or a notebook computer or the like.

The water blocking portion 10 can surround the periphery of the connector 01, and block the water leaking from the periphery of the connector 01 from flowing outwards from the connector 01, so as to achieve the waterproof of the periphery of the connector 01. The sealing portion 20 can seal the tail end of the connector 01, to prevent water from leaking from the tail end of the connector 01 to the outside of the connector, and it also can block water from coming into a space between the water blocking portion 10 and the connector 01. The waterproof cover 100 can seal the connector 01 well, so that the water getting inside the connector is unable to leak outside from the connector, to achieve the protection effect and to improve the safety performance.

In this embodiment, using an USB socket as an example of the connector 01, make following description for reference. Specifically, the connector 01 includes a head end 02 and a tail end 03 arranged opposite to the head end 02. The head end 02 is provided with an opening, i.e., an insertion port 04. The insertion port 04 is configured to be inserted with an external plug. The tail end 03 is fixed with a plurality of conductive pins 05. The plurality of conductive pins 05 extend to an inner side of the insertion port 04, and the plurality of conductive pins 05 are connected to a main board through conductive wires. That is, the tail end is electrically connected to a circuit board. Of course, in other embodiments, the connector 01 can be a headphone socket. The connector 01 may be provided with conductive pins 05 between the head end 02 and the tail end 03.

In this embodiment, the water blocking portion 10 is in a shape of a sleeve. The water blocking portion 10 includes a first end 11 and a second end 12 opposite to the first end 11. Both the first end 11 and the second end 12 are sleeved on a periphery of the connector 01. The first end 11 is close to the head end 02 of the connector 01. The second end 12 is close to the tail end 03 of the connector 01. The water blocking portion 10 further includes a first inner sidewall 13 connected between the first end 11 and the second end 12, and a first outer sidewall 14 opposite to the first inner sidewall 13. The periphery of the connector 01 is covered by the first inner sidewall 13 seamlessly. And the first inner sidewall 13 is fit to the periphery of the connector 01. When water leaks from the periphery of the connector 01, the water leakd is blocked by first inner sidewall 13, so that the water is unable to flow to the first outer sidewall 14. Thus the water entered the connector 01 from the head end 02 would only remain inside the connector 01 or leak to a space between the water blocking portion 10 and the periphery sidewall of the connector 01, so as to prevent the water from leaking outside from the periphery of the connector 01. Of course, in other embodiments, there is a space between the first inner sidewall 13 and connector 01, so as to improve the heat dispersion of the connector 01.

In this embodiment, the sealing portion 20 is a sealing ring. The sealing portion 20 is fastened to the second end 12 of the water blocking portion 10. The sealing portion 20 and the water blocking portion 10 are integrally formed. The sealing portion 20 encircles the tail end 03 of the connector 01, so that the tail end 03 of the connector 01 passes through the sealing portion 20. A conductive wire thus can be easily connected to an end surface of the tail end 03 of the connector 01. That means the end surface of the tail end 03 is located on an outside surface of the waterproof cover 100. The sealing portion 20 includes a second inner sidewall 21 with an inner diameter smaller than that of the first inner sidewall 13, so that the water is unable to flow continuously to the second inner sidewall 21 along the first inner sidewall 13. The outer sidewall of the tail end 03 is covered by the first inner sidewall 13 seamlessly to prevent the water at the tail end 03 from passing through the first inner sidewall 13. That is, the scaling portion 20 can prevent the water inside the connector 01 from passing through the sealing portion 20, and prevents the water leaking into a space between the peripheral sidewall of the connector 01 and the water blocking portion 10 from flowing continuously to the end surface of the tail end 03.

A first embodiment is provided, in which the second inner sidewall 21 is closely fit to the outer sidewall of the tail end 03 and corresponds to a smooth region of the outer sidewall of the tail end 03, so that the second inner sidewall 21 is abutted on the outer sidewall of the tail end 03 seamlessly. In this way, it prevents the water leaking into the space between the outer sidewall of the connector 01 and the water blocking portion 20 from permeating the sealing portion 20.

Figure 2:
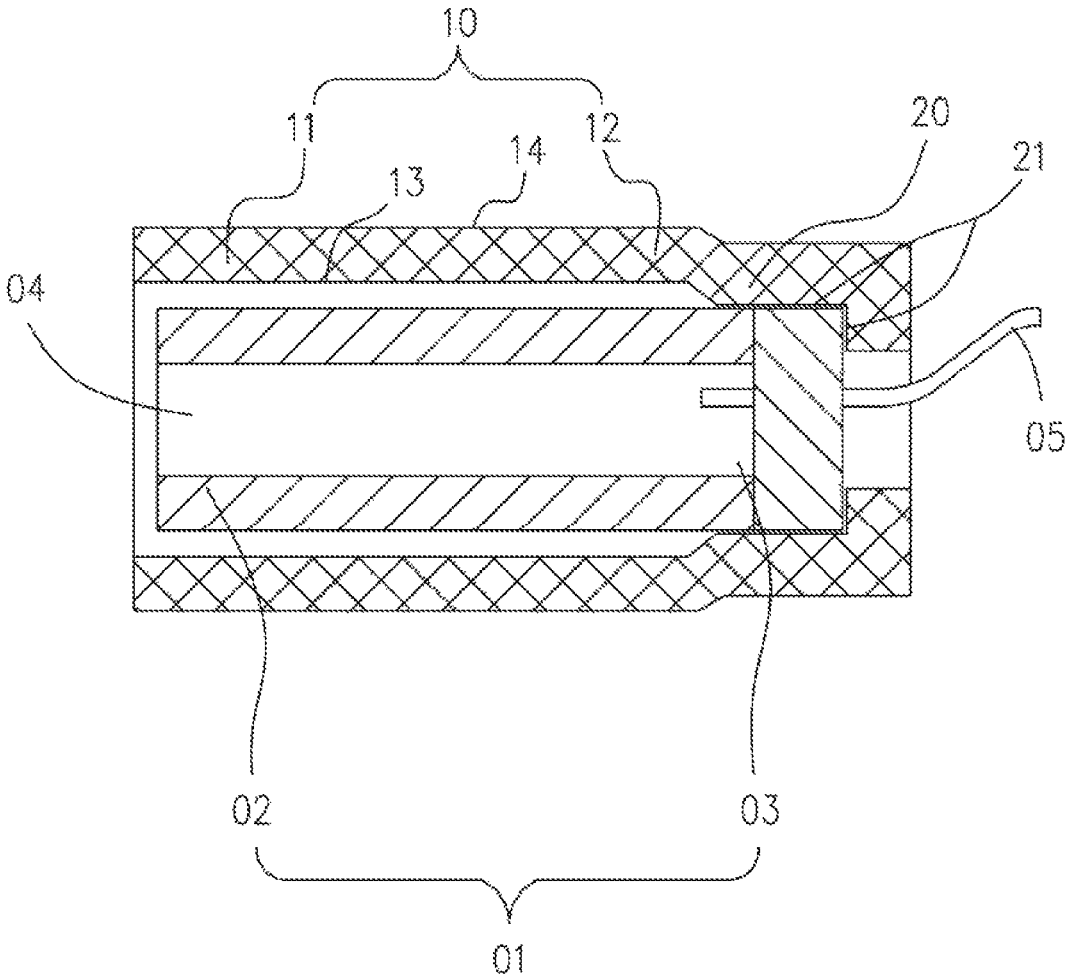
FIG. 2 is a schematic cross-sectional view of a waterproof cover according to a second embodiment of the present disclosure.

With reference to FIG. 2, a second embodiment is provided, in which the second inner sidewall is in a shape of a step. The second inner sidewall 21 is closely fit to both of the peripheral sidewall and the end surface of the tail end 03, so that the water flowing to the first inner sidewall 13 is blocked at the second end 12 by the second inner sidewall 21, and the water is unable to continue to flow through the sealing portion 20. In this way, the water inside the connector 01 is unable to leak to the end surface of the tail end 03, so that the water flowing inside the connector 01 is unable to further flow to an external component, which improves the safety and protection.

Figure 3:
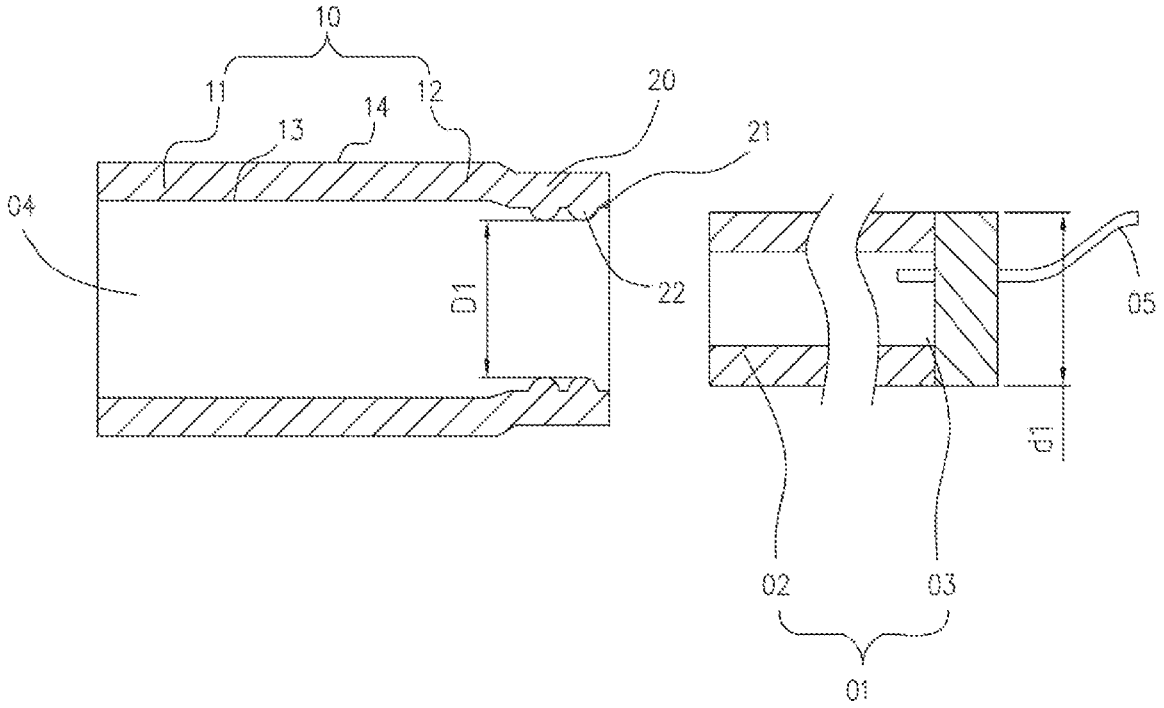
FIG. 3 is a schematic diagram showing a state where the waterproof cover of FIG. 1 is not sleeved on the connector.
Figure 4:
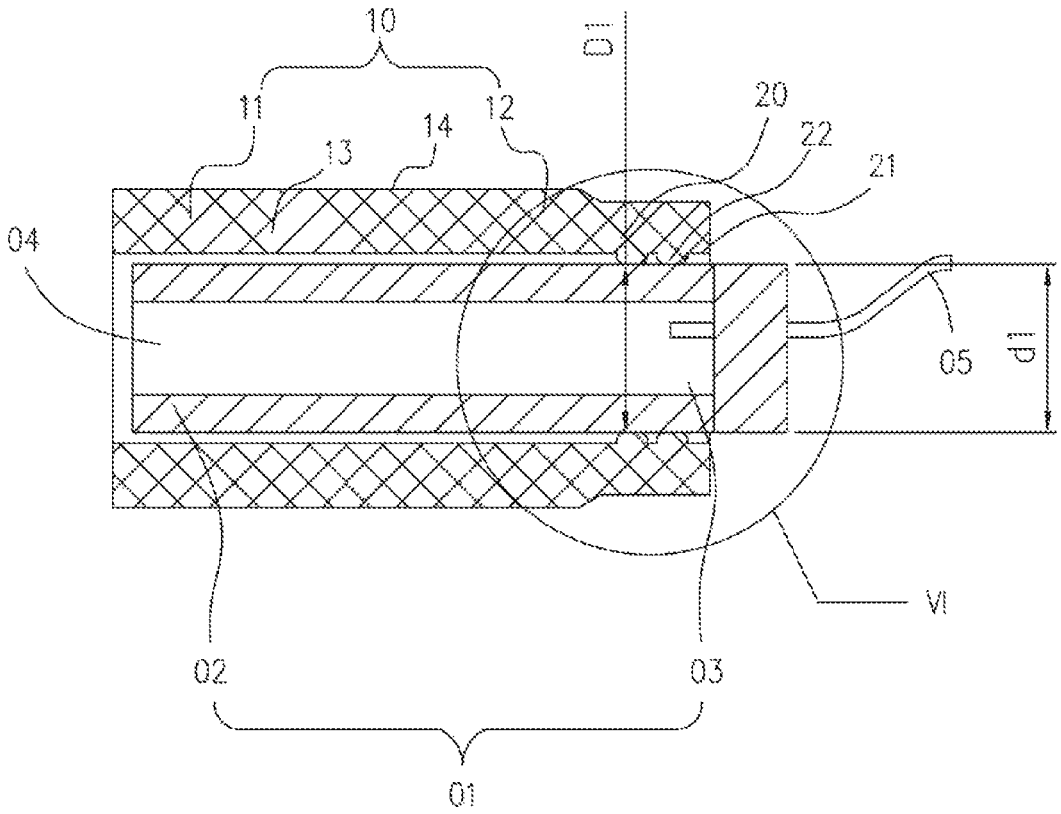
FIG. 4 is a schematic diagram showing a state where the waterproof cover of FIG. 1 is sleeved on the connector.

Further, with reference to FIG. 3 and FIG. 4. The inner sidewall of the sealing portion 20 is provided with a sealing waterproof rib 22 along a circumferential direction, and the sealing waterproof rib 22 is abutted on the outer sidewall of the connector 01.

In the first embodiment, the second inner sidewall 21 is provided with a sealing waterproof rib 22, so that the inner diameter of the second inner sidewall 21 is smaller than the inner diameter of the first inner sidewall 13. The sealing waterproof rib 22 is abutted on the outer sidewall of the tail end 03. The sealing waterproof rib 22 is made of an elastic, deformable material. As shown in FIG. 3, when the sealing portion 20 is not sleeved on the tail end 03, the inner diameter D1 of the second inner sidewall 21 is smaller than the outer diameter d1 of the tail end 03. As shown in FIG. 4, when the sealing portion 20 is sleeved on the peripheral side of the tail end 03, the inner diameter D1 of the second inner sidewall 21 is equal to the outer diameter d1 of the tail end 03, that is, the sealing waterproof rib 22 is expanded and deformed. In this case, the sealing waterproof rib 22 applies an extrusion force on the peripheral sidewall of the tail end 03 under the action of an elastically recovery stress of the sealing waterproof rib 22, so that the sealing waterproof rib 22 is abutted on the peripheral sidewall of the tail end 03 closely, to prevent the water from flowing between the peripheral sidewall of the tail end 03 and the second inner sidewall 21.

Further, in the first embodiment, there is a plurality of sealing waterproof ribs 22. The plurality of the sealing waterproof ribs 22 are arranged along a length of the waterproof cover. That is, the plurality of the sealing waterproof ribs 22 is arranged in a direction from the second end 12 to the first end 11. There is a gap between two adjacent sealing waterproof ribs 22, so as to facilitate each of the sealing waterproof ribs 22 to be pressed and deformed to form a extrusion force applied on the peripheral sidewall of the tail end 03. Further, multiple blocking structures can be formed at the tail end 03 to improve the waterproof performance. And the sealing waterproof ribs 22 are independent of each other, so that when the peripheral sidewall of the tail end 03 is uneven, the plurality of the sealing waterproof ribs 22 can be still abutted on the peripheral sidewall of the tail end 03 closely.

Figure 5:
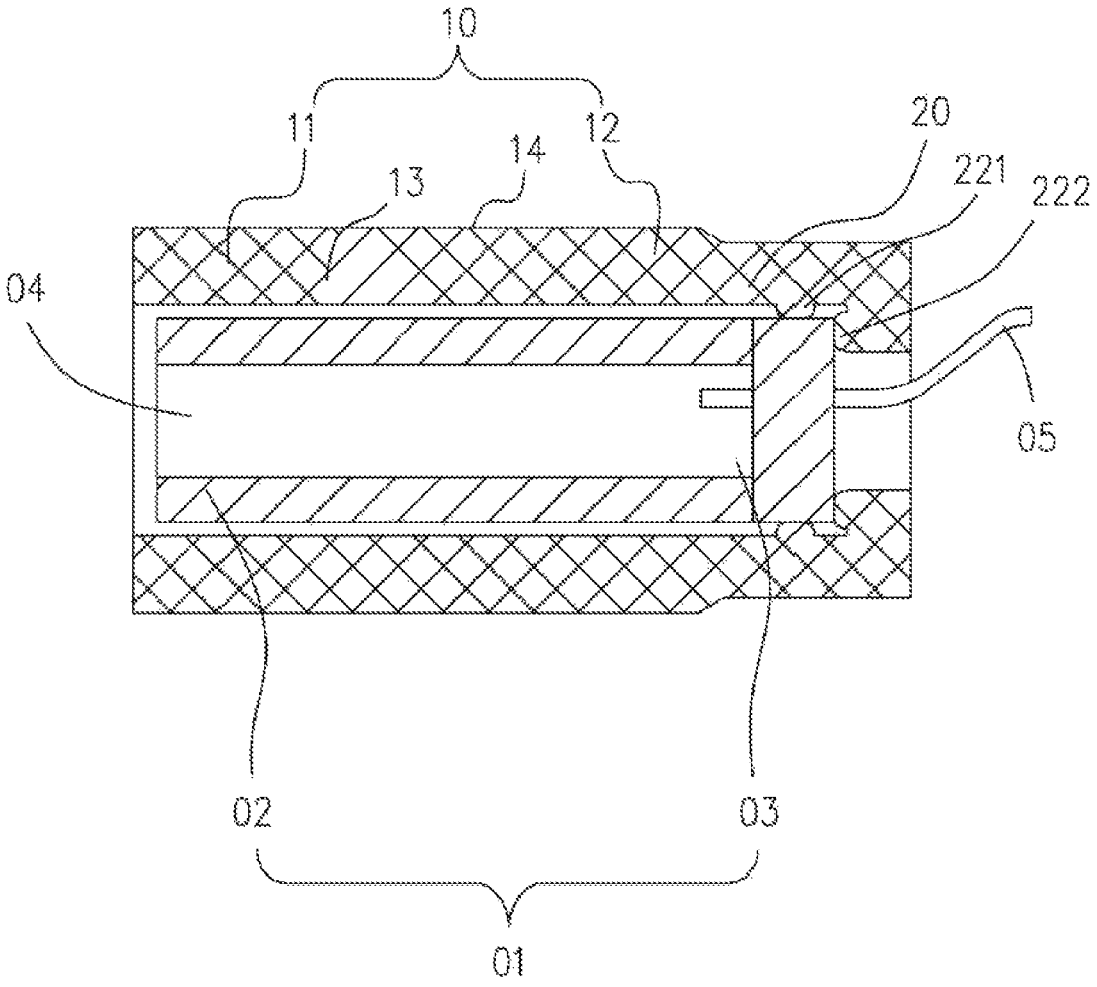
FIG. 5 is a schematic diagram showing a state where the waterproof cover of FIG. 2 is not sleeved on the connector.

With reference to FIG. 5, in the second embodiment, which is substantially the same as the first embodiment, except that the second inner sidewall 21 is provided with a plurality of first sealing waterproof ribs 221 and second sealing waterproof ribs 222. The first sealing waterproof ribs 221 are abutted on the peripheral sidewall of the tail end 03, while the second sealing waterproof ribs 222 are abutted on the end surface of the tail end 03. The first sealing waterproof ribs 221 and the second sealing waterproof ribs 222 prevent the water from flowing along the peripheral sidewall and the end surface of the tail end 03, to achieve multiple waterproof effects.

Figure 6:
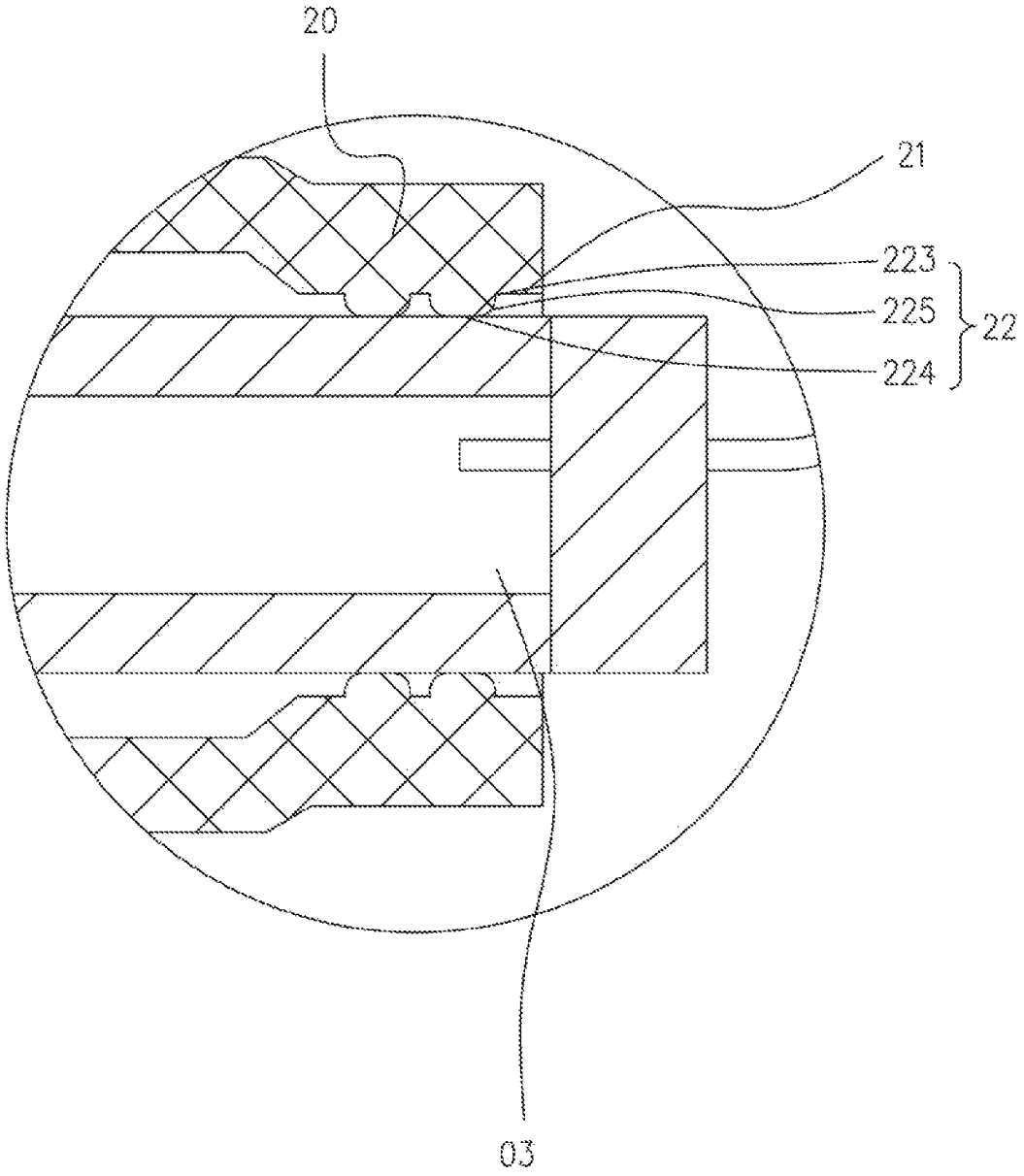
FIG. 6 is an enlarged view of a part VI in FIG. 4.

Further, with reference to FIG. 3, FIG. 4 and FIG. 6, Each of the sealing waterproof ribs 22 has a root portion 223, a top portion 224 opposite to the root portion 223, and a shoulder portion 225 connected between the root portion 223 and the top portion 224. Two adjacent shoulder portions 225 are closer to each other as the top portion 224 abuts against an outer sidewall of the connector 01.

In this embodiment, the cross section of the sealing waterproof rib 22 is in a semicircular shape. The root portion 223 is arranged on the second inner sidewall 21. The top portion 224 is abutted on the peripheral sidewall of the tail end 03. Since the top portion 224 is subjected to a backward extrusion pressure from the peripheral sidewall of the tail end 03, and the top portion 224 applies an extrusion force to the shoulder portion 225, the shoulder portions 225 of the two sealing waterproof ribs 22 are closer to each other under the extrusion force. In this case, space between the two adjacent sealing waterproof ribs 22 is contracted, to prevent water from remaining between the two adjacent sealing waterproof ribs 22, and further prevent the tail end 03 of the connector 01 from being corroded by water, so as to improve the safety. Of course, in other embodiments, the cross section of the sealing waterproof rib 22 may be in a trapezoid shape.

Figure 7:
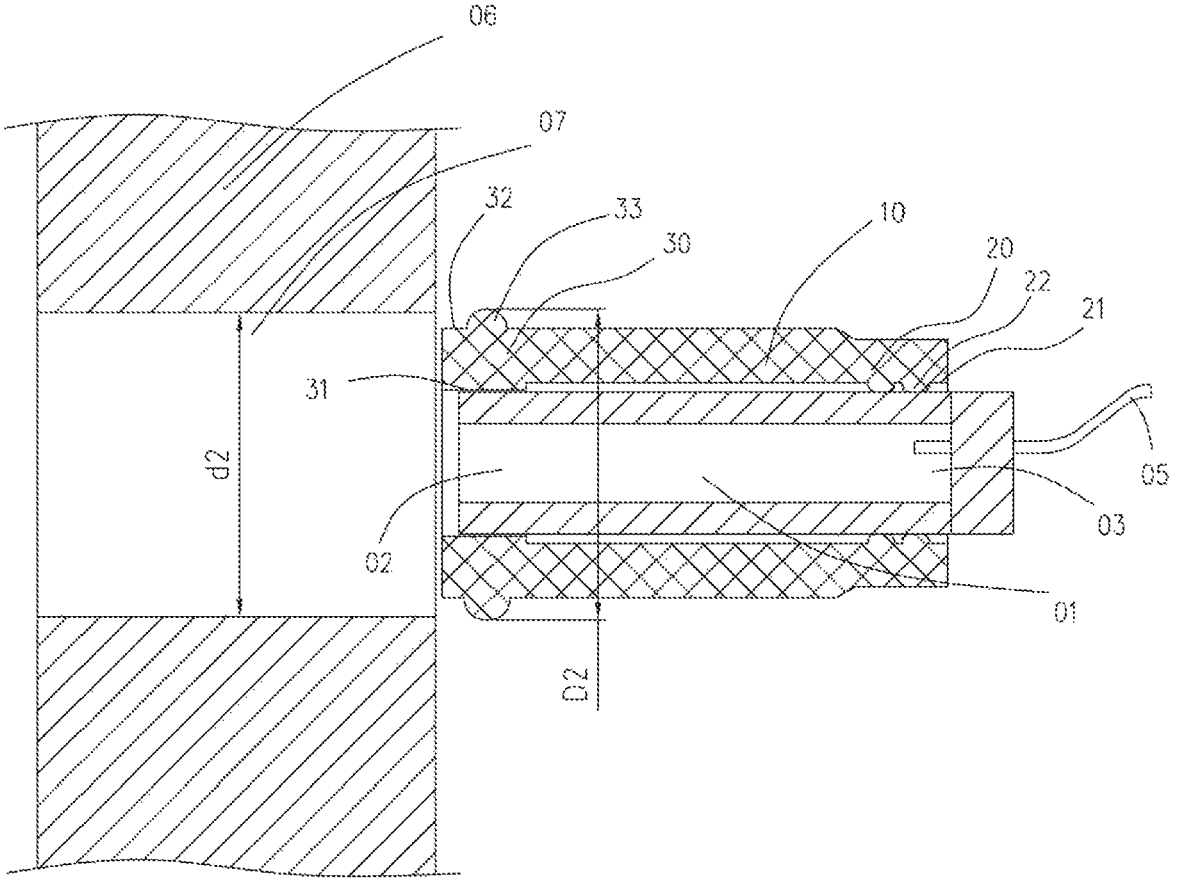
FIG. 7 is a schematic diagram showing a state where the waterproof cover and the connector of FIG. 1 are not inserted into a housing.
Figure 8:
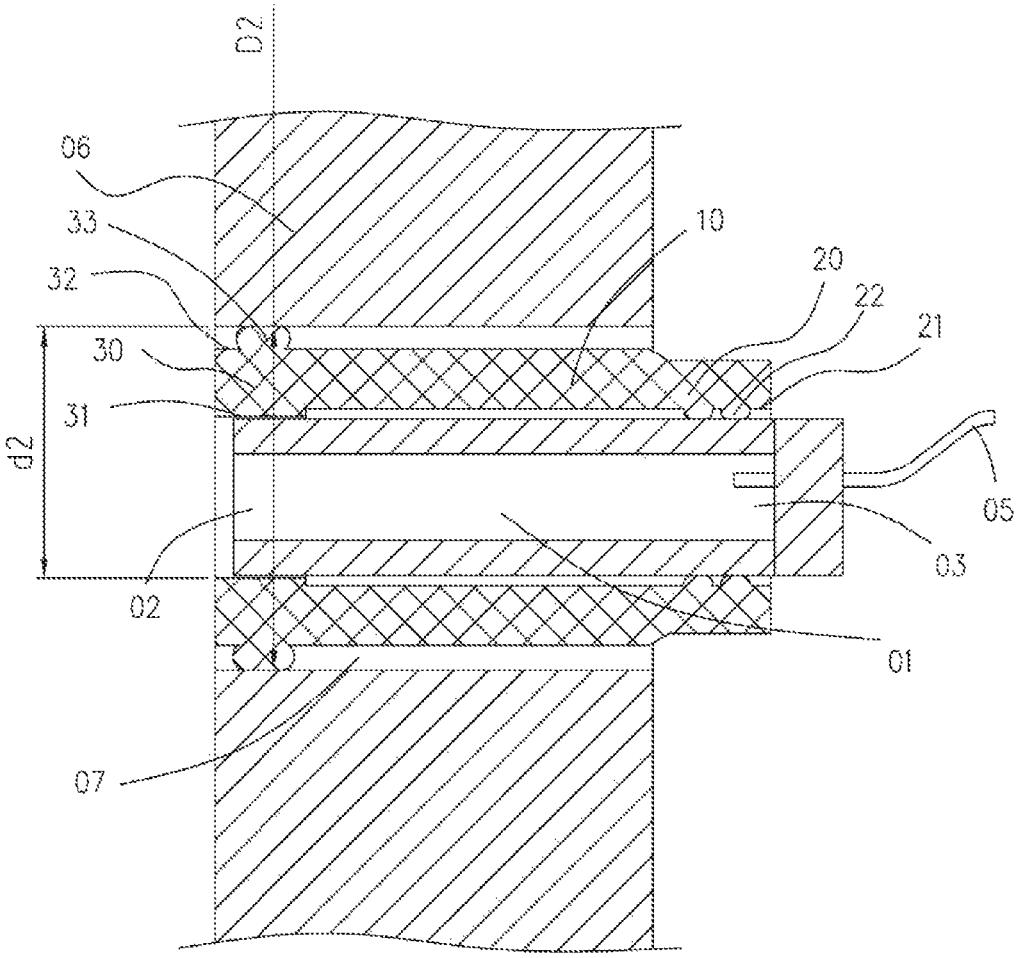
FIG. 8 is a schematic diagram showing a state where the waterproof cover and the connector of FIG. 1 are inserted into a housing.

Further, with reference to FIG. 7 and FIG. 8, the waterproof cover 100 (see FIG. 1) further includes an inserting portion 30 fastened to an end of the water blocking portion 10 opposite to the sealing portion 20. The inserting portion 30 is configured to be inserted into an aperture 07 of a housing 06. An outer sidewall of the inserting portion 30 is abutted on the inner sidewall of the aperture 07 closely.

In this embodiment, the inserting portion 30 is sleeved on the head end 02 of the connector 01. The inserting portion 30 is in a shape of a ring. The inserting portion 30 and the water blocking portion 20 are integrally formed. Both the head end 02 and the inserting portion 20 are inserted into the aperture 07 of the housing 06. The housing 06 can be a mounting seat for the connector 01. The tail end 03 of the connector 01 is located inside the housing 06 and electrically connected to an external device fastened to the housing 06. The inserting portion 30 includes a third inner sidewall 31 and a third outer sidewall 32. The third inner sidewall 31 is fit to the periphery of the head end 02. The third outer sidewall 32 is arranged oppositely to the third inner sidewall 31. The outer diameter of the third outer sidewall 32 is greater than the inner diameter of the aperture 07, so after the third outer sidewall 32 is inserted into the aperture 07, the third outer sidewall 32 is pressed to apply an expansion recovery force on the inner sidewall of the aperture 07. In this case, the third outer sidewall 32 is abutted on the inner sidewall of the aperture 07 closely, so as to realize the seamless connection between the inserting portion 30 and the housing 06. Thus water outside the housing 06 is unable to leak into the housing 06 from the connection between the inserting portion 30 and the aperture 07, and the water is unable to leak to the external device connected to the connector 01. Water outside the housing 06 may get inside to the connector 01 only through the insertion port 04 of the connector 01, and leak to a space between the connector 01 and the water blocking portion 10 through the opening of the inserting portion 30. Because of the blocking effect of the water blocking portion 10 and the sealing portion 20, the water is unable to flow to the external device electrically connected to the connector 01. The third outer sidewall 31 and the first sidewall 14 may be flushed with each other, and the third inner sidewall 32 and the first inner sidewall 13 may be flushed with each other, so it is convenient for the inserting portion 30 to be inserted into the aperture 07, and for the head end 02 of the connector 01 to be inserted into the inserting portion 30. Of course, in other embodiments, the third inner sidewall 32 and the first inner sidewall 13 may be staggered, and the third outer sidewall 31 and the first outer sidewall 14 may be staggered.

Further, the outer sidewall of the inserting portion 30 is provided with an aperture waterproof rib 33 along a circumferential direction, and the aperture waterproof rib 33 is abutted on the inner sidewall of the aperture 07.

In this embodiment, the third outer sidewall 31 is provided with the aperture waterproof rib 33, so that the outer diameter of the third outer sidewall 31 is greater than the inner diameter of the inner sidewall of aperture 07. The aperture waterproof rib 33 is abutted on the inner sidewall of the aperture 07. The aperture waterproof rib 33 is made of an elastic deformable material. The cross section of the aperture waterproof rib 33 is in a semicircular shape. As shown in FIG. 7, when the inserting portion 30 is not inserted into the aperture 07, the inner diameter D2 of the third outer sidewall 31 is smaller than the inner diameter d2 of the aperture 07. As shown in FIG. 8, when the inserting portion 30 is inserted into the aperture 07, the outer diameter D2 of the third outer sidewall 21 is equal to the inner diameter d2 of the aperture 07, that is, the aperture waterproof rib 33 is expanded and deformed. In this case, the aperture waterproof rib 33 applies an extrusion force on the inner sidewall of the aperture 07 under the action of an elastically recovery stress of the aperture waterproof rib 33, so that the aperture waterproof rib 33 is abutted on the inner sidewall of the aperture 07 closely, to prevent the water from percolating through connection between the inner sidewall of the aperture 07 and the third outer sidewall 31. More specifically, the third outer sidewall 31 is provided with a single aperture waterproof rib 33, to facilitate the insertion of the inserting portion 30 into the aperture 07. Since the aperture 07 is pressed against the inserting portion 30, the third inner sidewall 32 is in contact with the peripheral sidewall of the head end 02 tightly. The inserting portion 30 stabilizes the head end 02, so as to facilitate the head end 02 to fit with the connecting plug.

Figure 9:
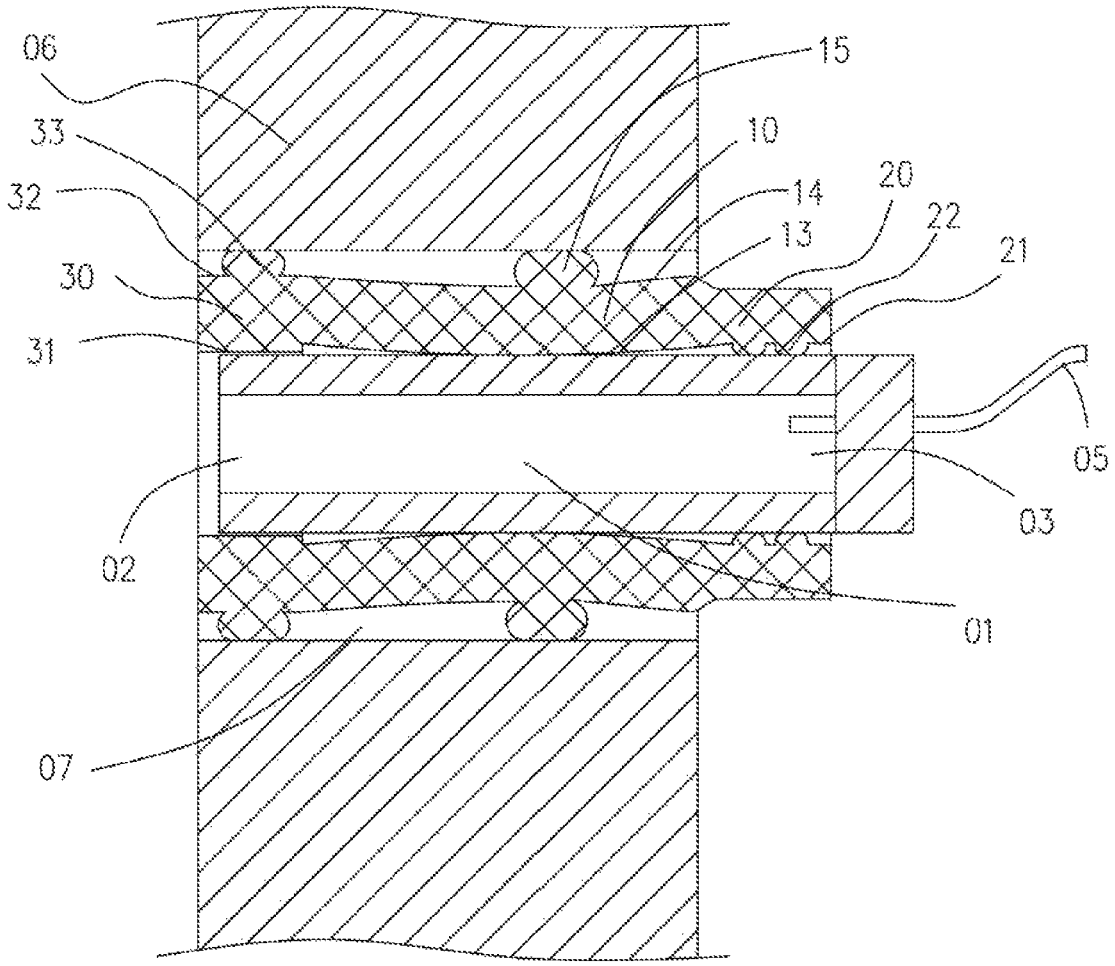
FIG. 9 is a schematic diagram showing another state where the waterproof cover and the connector of FIG. 1 are inserted into a housing.

Further, with reference to FIG. 9, the water blocking portion 10 is inserted into the aperture 07 of the housing 06. The outer sidewall of the water blocking portion 10 is provided with an outer side waterproof rib 15 along the circumferential direction. The outer side waterproof rib 15 is abutted on the inner sidewall of the aperture 07.

In this embodiment, the first outer sidewall 14 is provided with the outer side waterproof rib 15. The cross section of the outer side waterproof rib 15 is in a semicircular shape. The outer side waterproof rib 15 is also made of an elastic deformable material. The outer side waterproof rib 15 is deformed under extrusion from the aperture 07. The outer side waterproof rib 15 applies an extrusion force on the inner sidewall of the aperture 07 under the action of an elastically recovery stress of the outer side waterproof rib 15, so that the outer side waterproof rib 15 is abutted on the inner sidewall of the aperture 07 tightly, to prevent the water from leaking between the inner sidewall of the aperture 07 and the first outer sidewall 14. Further, when a little water leaks the aperture waterproof rib 33, the outer side waterproof rib 15 can further block the water, so as to achieve multiple waterproof effects between the waterproof cover 100 and the housing 06. More specifically, the outer side waterproof rib 15 is pressed by the inner sidewall of the aperture 07. The first inner sidewall 13 of the water blocking portion 10 is abutted on a part of the outer sidewall of the connector 01 opposite to the outer side waterproof rib 15. Thus the fit performance between the first inner sidewall 13 and the peripheral sidewall of the connector 01 can be improved, and water inside the connector 01 can be further prevented from leaking out. Of course, in other embodiments, the cross section of the outer side waterproof rib 15 may be in a trapezoid shape.

Further, the sealing portion 20 is closer to the outer side waterproof rib 15 than the inserting portion 30. It improves the sealing performance of the first sidewall 13 near the sealing portion 20, to prevent the water inside the connector 01 from approaching the sealing portion 20, and further prevent the water from leaking out of the sealing portion 20.

Figure 10:
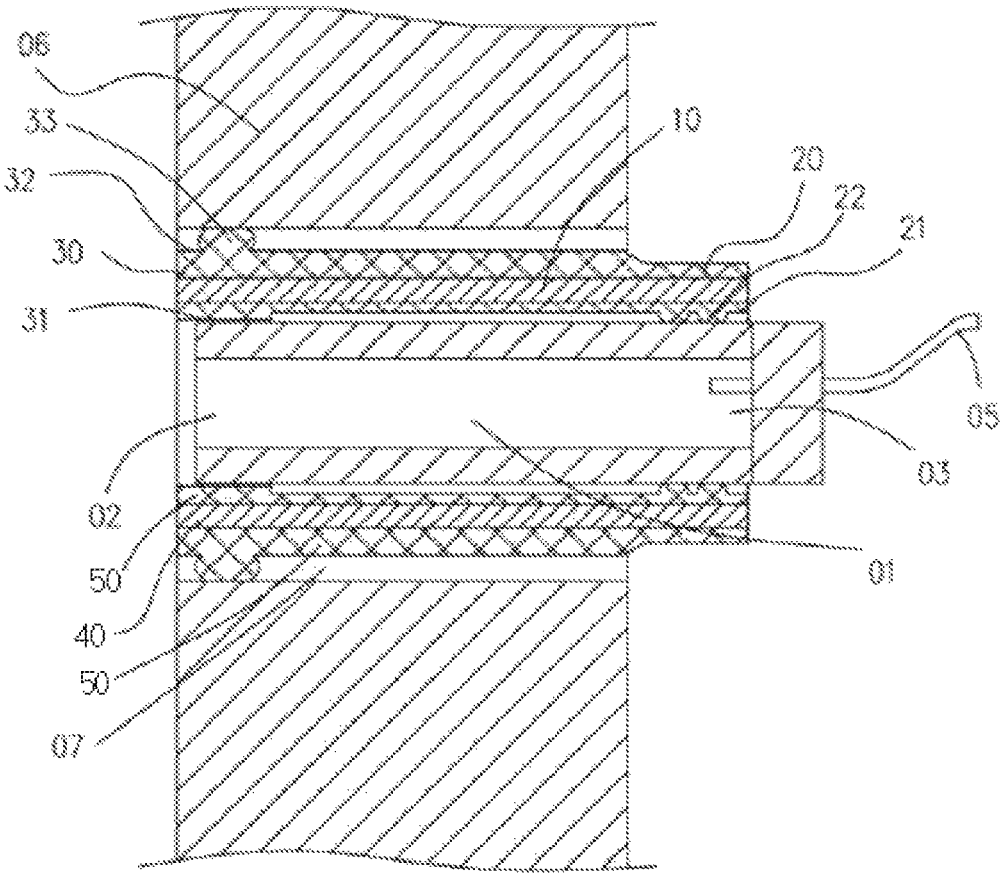
FIG. 10 is a schematic diagram showing another state where the waterproof cover and the connector of FIG. 1 are inserted into a housing.

Further, with reference to FIG. 10, the waterproof cover 100 is made up of a hard layer 40 and a flexible layer 50 that is laminated on the hard layer 40. The sealing waterproof rib 22 is integrally formed with the flexible layer 50.

In this embodiment, the hard layer 40 may be a metal plate. The flexible layer 50 may be made of a flexible plastic material with elastic recovery stress. For example, the flexible layer 50 is made of silicone. The hard layer 40 and the flexible layer 50 are integrally formed by an in-mold injection molding process. The flexible layer 50 covers the hard layer 40. Both the flexible layer 50 and the hard layer 40 are sleeved on the periphery of the connector 01. The flexible layer 50 is located on both the inner side and outer side of the hard layer 40. The sealing waterproof rib 22 is arranged on the flexible layer 50. The flexible layer 50 is fit to the peripheral sidewall of the connector 01. The aperture waterproof rib 33 and the outer waterproof rib 15 are also arranged on the flexible layer 50. The flexible layer 50 is further fit to the inner sidewall of the aperture 07. By using the hard layer 40 located inside the flexible layer 50, the waterproof cover 100 is less likely to be deformed in the length direction. It thus facilities the waterproof cover 100 to be sleeved on the connector 01. Meanwhile, it also facilities the waterproof cover 100 to be inserted into the aperture 07 of the housing 06. The flexible layer 50 covers the hard layer 40, to enhance the fit performance between the outer sidewall and the inner sidewall of the waterproof cover 100, the sealing performance between the waterproof cover 100 and the connector 01, and the sealing performance between the waterproof cover 100 and the housing 06. Of course, in other embodiments, the flexible layer 50 may also be arranged on one side of the hard layer 40.

Figure 11:
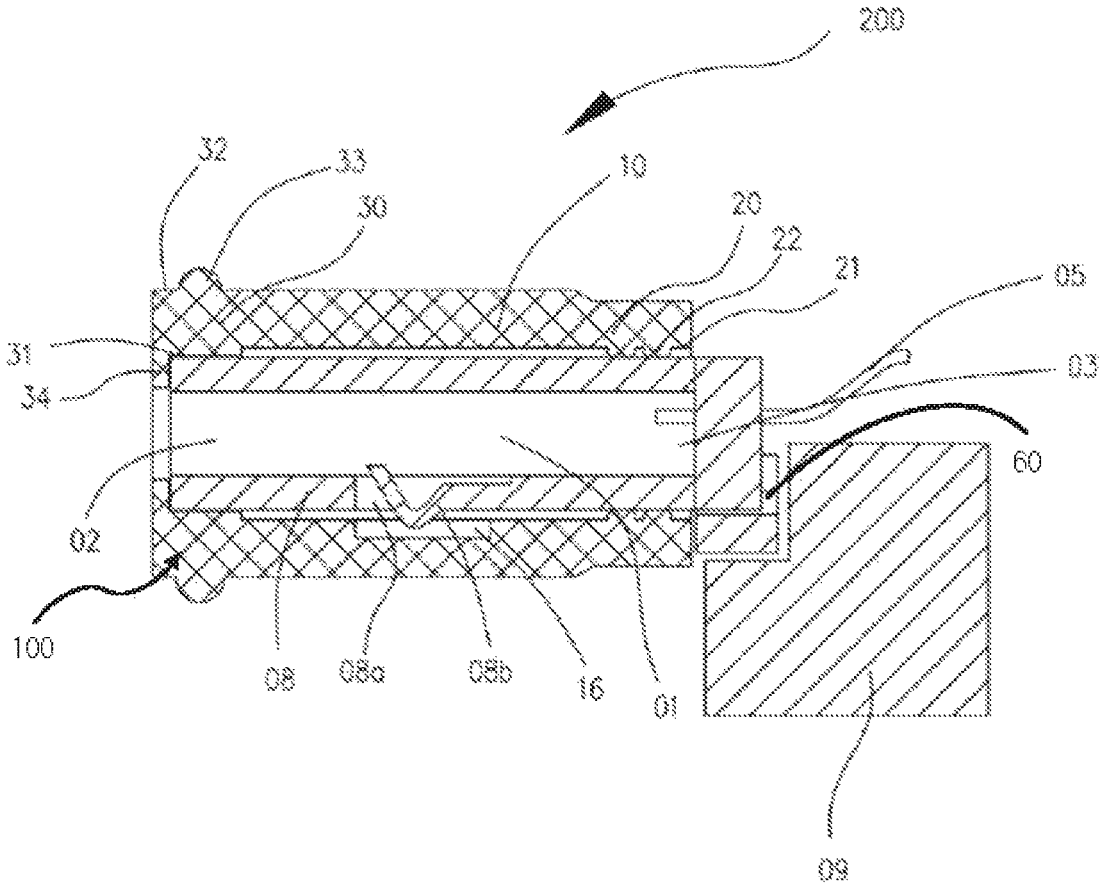
FIG. 11 is a schematic cross-sectional view of a connection device according to one embodiment of the present disclosure.

Further, with reference to FIG. 11, the present disclosure also provides a connection device 200. The connection device 200 includes the above waterproof cover 100. The connection device 200 further includes a connector 01 fit into the water blocking portion 10. The connector 01 includes a tail end 03. The tail end 03 passes through the sealing portion 20 and configured to be connected to a conductive wire. The connector 01 further includes a head end 02 opposite to the tail end 03. The waterproof cover 100 further includes an inserting portion 30 fastened to an end of the water blocking portion 10 opposite to the sealing portion 20. The inserting portion 30 is sleeved on the head end 02. An inner sidewall of the inserting portion 30 is provided with a limiting rib 34 abutted on an end surface of the head end 02. Specifically, the limiting rib 34 is arranged on the third inner sidewall 32. The limiting rib 34 limits the head end 02, to prevent the head end 02 from passing through the inserting portion 30, and to protect the head end 02 of the connector 01.

Further, the connector 01 further includes an insertion board 08 extending from the head end 02 to the tail end 03. The insertion board 08 is provided with a through hole 08*a* and an elastic piece 08*b* extending outward from an inner sidewall of the through hole 08*a*. The inner sidewall of the water blocking portion 10 is provided with a groove 16 matching the elastic piece 08*b*.

In this embodiment, the insertion board 08 is made of a metal plate. The insertion board 08 is a metal member in a cylinder shape formed by bending a flat metal plate and welding a joint of the bended plate, with a stable structure. However, since there is a welded joint on the insertion board 08, water tends to permeate the insertion board 08 easily. The water blocking portion 10 covers the periphery of the insertion board 08, so that it prevents the water leaking from the insertion board 08 from flowing outside the insertion board 08. The through hole 08*a* and the elastic piece 08*b* are both formed by pressing process. Since the insertion board 08 needs to be inserted with an external plug, it needs to use the elastic piece 08*b* to press against the external plug to stabilize the connection between the external plug and the connector 01, and to improve the insertion performance of the connector 01. Since the through hole 08*a* is arranged on the insertion board 08, the water inside the connector 01 may also leak through the through hole 08*a* easily. The through hole 08*a* is blocked or sealed by the water blocking portion 10, to prevent the leak of the through hole 08*a*. A part of the first inner sidewall 13 corresponding to the elastic piece 08*b* is provided with a groove 16. A part of the elastic piece 08*b* extends out of the groove 16 after the bending processing, so the elastic piece 08*b* can match the groove 16, to insert and position the connector 01 into the waterproof cover 100. Of course, in other embodiments, the first inner sidewall 13 is provided with a positioning column corresponding to the through hole 08*a*. With the cooperation between the positioning column and the through hole 08*a*, the connector 01 can be inserted and positioned into the waterproof cover 100.

Further, the connection device 200 further includes a mounting bracket 60. The mounting bracket 60 is fixedly connected to the tail end 03 of the connector 01 for fastening the waterproof cover 100 and the connector 01 to a middle frame 09.

In this embodiment, the mounting seat 60 is a bended metal plate. The mounting seat 60 is located outside the waterproof cover 100 and inside the housing 06. The mounting seat 60 includes two free ends 61 opposite to each other and a bended arm 62 connected between the two free ends 61. The bended arm 62 is fixedly connected to the tail end 03. The two free ends 61 are fastened to the middle frame 09. Specifically, the bended arm 62 is welded to the peripheral sidewall of the tail end 03. The free ends 61 are fastened to the middle frame 09 via bolts. In this way, the mounting seat 60 is in conduction with the connector 01 and the middle frame 09, so that static electricity of the connector 01 is transmitted to a ground of the middle frame 09, to achieve static electricity proof for the connector 01.

Figure 12:
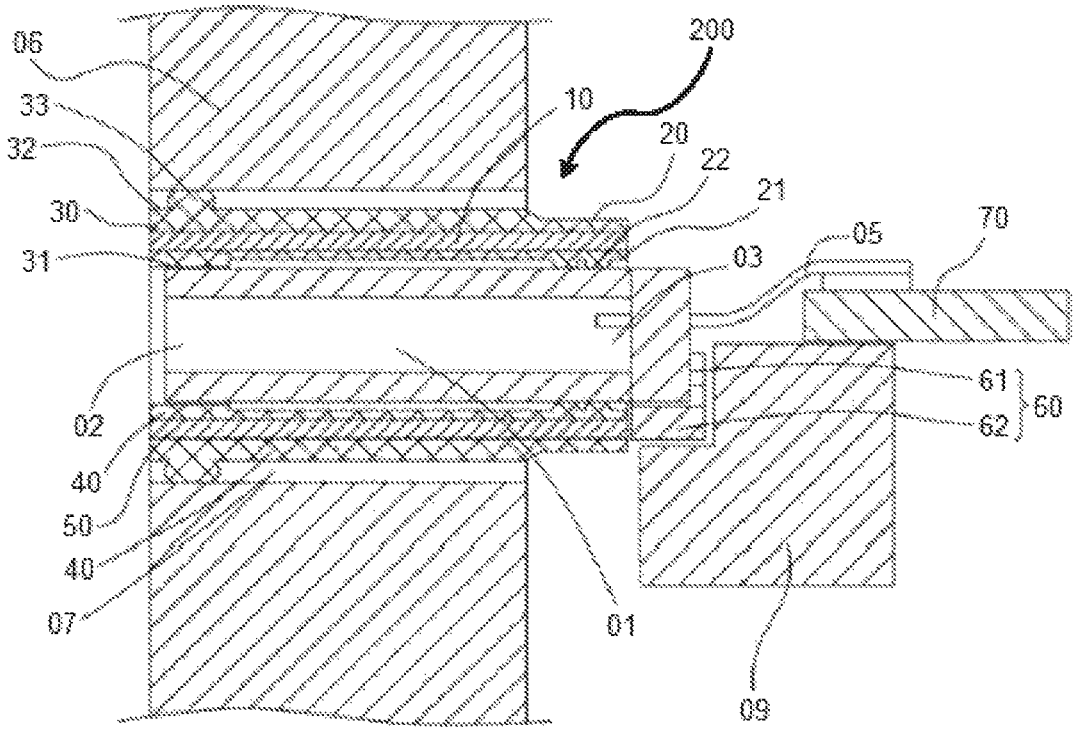
FIG. 12 is a partial cross-sectional view of a mobile terminal according to one embodiment of the present disclosure.

Further, with reference to FIG. 12, the present disclosure further provides a mobile terminal 300. The mobile terminal 300 includes the above connection device 200. The mobile terminal 300 further includes a housing 06. The housing 06 is provided with an aperture 07. The connector 01 can passes through the aperture 07, and the sealing portion 20 can seals the aperture 07. An end of the connector 01 opposite to the tail end 03 is inserted into the aperture 07. An end of the waterproof cover 100 (shown in FIG. 1) away from the sealing portion 20 is sealed between the inner sidewall of the aperture 07 and the connector 01. That is, the head end 02 and the inserting portion 30 are both inserted into the aperture 07. The inserting portion 30 is sealed between the inner sidewall of the aperture 07 and the connector 01. The housing 06 may be a housing of the mobile terminal 300. The mobile terminal 300 further includes a main board 70 and a middle frame 09. The main board 70 is fastened on an inner side of the housing 06, and electrically connected to the tail end 03 of the connector 01. The middle frame 09 is fastened on the inner side of the housing 06. Both the main board 70 and the tail end 03 of the connector 01 are fastened to the middle frame 09. The main board 70 and the middle frame 09 can be protected by the housing 06, and the waterproof cover 100 prevents water from leaking inside the housing 06, and prevents the main board 70 from being damaged by a short circuit caused by the water.

For the waterproof cover, the connection device and the mobile terminal according to the present disclosure, the water blocking portion can cover the periphery of the connector, and block the water leaking from the periphery of the connector from flowing outwards from the connector, so as to achieve the waterproof of the periphery of the connector. The sealing portion can seal the tail end of the connector, to prevent water from leaking from the tail end of the connector to the outside of the connector, and it also can block water in a space between the water blocking portion and the connector. The waterproof cover can seal the connector well, so that the water getting inside the connector is unable to leak outside from the connector, to achieve the protection effect and to improve the safety performance.

Disclosed above are only the preferred embodiments of the present disclosure. It is appreciated that those having ordinary skills of the art may readily appreciate various improvements and modifications without departing from the principle of the present disclosure and these improvements and modifications are considered within the protection scope of the present disclosure.

What is claimed is:

1. A waterproof cover for a connector, comprising:

a water blocking portion, configured to surround a periphery of the connector; and a sealing portion, fastened to an end of the water blocking portion, and configured to be sleeved on a tail end of the connector to seal the tail end of the connector, to block water in a space between the water blocking portion and the connector, wherein an inner sidewall of the water blocking portion is provided with a groove matching an elastic piece that is extended outward from an inner sidewall of a through hole provided on an insertion board of the connector, the insertion board being extended from a head end of the connector to the tail end of the connector opposite to the head end, and the elastic piece being configured to, when an external plug is inserted into the connector, press against the external plug to stabilize a connection between the external plug and the connector.

2. The waterproof cover of claim 1, wherein the waterproof cover further comprises an inserting portion fastened to an end of the water blocking portion opposite to the sealing portion, the inserting portion is configured to be inserted into an aperture of a housing, and an outer sidewall of the inserting portion is configured to be abutted on an inner sidewall of the aperture closely when the inserting portion is inserted into the aperture.

3. The waterproof cover of claim 2, wherein the outer sidewall of the inserting portion is provided with an aperture waterproof rib along a circumferential direction, and the aperture waterproof rib is configured to be abutted on the inner sidewall of the aperture.

4. The waterproof cover of claim 2, wherein the water blocking portion is configured to be inserted into the aperture of the housing, an outer sidewall of the water blocking portion is provided with an outer side waterproof rib along a circumferential direction, and the outer side waterproof rib is configured to be abutted on an inner sidewall of the aperture.

5. The waterproof cover of claim 4, wherein the outer side waterproof rib is configured to be pressed by an inner sidewall of the aperture, so that a part of an inner sidewall of the water blocking portion opposite to the outer side waterproof rib is abutted on an outer sidewall of the connector.

6. The waterproof cover of claim 5, wherein the sealing portion is closer to the outer side waterproof rib than the inserting portion.

7. The waterproof cover of claim 1, wherein an inner sidewall of the sealing portion is provided with a sealing waterproof rib along a circumferential direction, and the sealing waterproofing rib is configured to be abutted on an outer sidewall of the connector.

8. The waterproof cover of claim 7, wherein the waterproof cover is made up of a hard layer and a flexible layer laminated on the hard layer, and the sealing waterproof rib and the flexible layer are integrally formed.

9. The waterproof cover of claim 7, wherein there is a plurality of sealing waterproof ribs, and the plurality of sealing waterproof ribs are arranged along a length of the waterproof cover.

10. The waterproof cover of claim 9, wherein each of the sealing waterproof ribs has a root portion, a top portion opposite to the root portion, and shoulder portions connected between the root portion and the top portion, and two adjacent shoulder portions are closer to each other as the top portion abuts against an outer sidewall of the connector.

11. The waterproof cover of claim 1, wherein an inner side wall of the water blocking portion has an inner diameter larger than an inner side wall of the sealing portion.

12. A connection device, comprising:

a waterproof cover, comprising:

a water blocking portion, configured to surround a periphery of a connector; and a sealing portion, fastened to an end of the water blocking portion, and configured to be sleeved on a tail end of the connector to seal the tail end of the connector, to block water in a space between the water blocking portion and the connector; and the connector, configured to fit into the water blocking portion of the waterproof cover, wherein the tail end of the connector passes through the sealing portion of the waterproof cover and is configured to be connected to a conductive wire, wherein the connector further comprises: a head end opposite to the tail end of the connector and an insertion board extended from the head end to the tail end of the connector, the insertion board being provided with a through hole and an elastic piece extending outward from an inner sidewall of the through hole, the inner sidewall of the water blocking portion being provided with a groove matching the elastic piece, and the elastic piece being configured to, when an external plug is inserted into the connector, press against the external plug to stabilize a connection between the external plug and the connector.

13. The connection device of claim 12, wherein the waterproof cover further comprises an inserting portion fastened to an end of the water blocking portion opposite to the sealing portion, the inserting portion is sleeved on the head end, and an inner sidewall of the inserting portion is provided with a limiting rib configured to be abutted on an end surface of the head end.

14. The connection device of claim 12, wherein the connection device further comprises a mounting bracket, the mounting bracket is fixedly connected to the tail end of the connector for fastening the waterproof cover and the connector on a middle frame.

15. The connection device of claim 14, wherein the mounting bracket is a bended plate, the mounting bracket comprises two free ends opposite to each other and a bended arm connected between the two free ends, the bended arm is fixedly connected to the tail end of the connector, and the two free ends are fastened to the middle frame.

16. The connection device of claim 14, wherein the mounting bracket is a metal member, and the mounting bracket is in conduction with the connector and the middle frame, so that static electricity of the connector is transmitted to a ground of the middle frame.

17. A mobile terminal, comprising:

a connector, comprising a head end having an opening and a tail end electrically connected to a main board;

a waterproof cover for the connector, comprising:

a water blocking portion, configured to surround a periphery of the connector; and a sealing portion, fastened to an end of the water blocking portion, and configured to be sleeved on the tail end of the connector to seal the tail end of the connector, to block water in a space between the water blocking portion and the connector; and a housing having an aperture, wherein the connector passes through the aperture, and the sealing portion seals the aperture; and wherein the connector further comprises: the head end opposite to the tail end of the connector and an insertion board extended from the head end to the tail end of the connector, the insertion board being provided with a through hole and an elastic piece extending outward from an inner sidewall of the through hole, the inner sidewall of the water blocking portion being provided with a groove matching the elastic piece, and the elastic piece being configured to, when an external plug is inserted into the connector, press against the external plug to stabilize a connection between the external plug and the connector.

18. The mobile terminal of claim 17, wherein the main board is fastened within the housing.

19. The mobile terminal of claim 18, further comprising a middle frame, the middle frame being fastened within the housing, and both the main board and the tail end of the connector being fastened to the middle frame.

* * * * *